US007837243B2

(12) United States Patent
Stiglich

(10) Patent No.: US 7,837,243 B2
(45) Date of Patent: Nov. 23, 2010

(54) LOCKING ASSEMBLY FOR REAR DOOR

(75) Inventor: DeeAnna Stiglich, Highland, MI (US)

(73) Assignee: Magna Closures Inc., Newmarket, Ontario (CA)

( * ) Notice: Subject to any disclaimer, the term of this patent is extended or adjusted under 35 U.S.C. 154(b) by 370 days.

(21) Appl. No.: 11/352,506

(22) Filed: Feb. 10, 2006

(65) Prior Publication Data

US 2006/0192392 A1 Aug. 31, 2006

Related U.S. Application Data

(60) Provisional application No. 60/652,558, filed on Feb. 14, 2005.

(51) Int. Cl.
*E05B 3/00* (2006.01)

(52) U.S. Cl. ..... 292/336.3; 292/DIG. 21; 296/146.1

(58) Field of Classification Search ..... 292/336.3, 292/216, DIG. 21; 296/146.1
See application file for complete search history.

(56) References Cited

U.S. PATENT DOCUMENTS 5,749,611 A 5/1998 Watson et al.
5,803,516 A 9/1998 Hempel
6,299,223 B1 * 10/2001 Ji et al. ..... 292/175
6,692,045 B1 * 2/2004 Mc Call, Jr. ..... 292/281
6,694,676 B2 * 2/2004 Sakamoto et al. ..... 49/366
6,752,440 B2 6/2004 Spurr
6,848,737 B2 * 2/2005 Mikolai et al. ..... 296/146.9
6,964,440 B2 * 11/2005 Lebsack et al. ..... 292/336.3
7,059,654 B2 * 6/2006 Ichinose ..... 296/146.1
2006/0131892 A1 * 6/2006 Pereverzev ..... 292/216

* cited by examiner

*Primary Examiner*—Peter M Cuomo
*Assistant Examiner*—Kristina R Fulton
(74) *Attorney, Agent, or Firm*—Clark Hill PLC

(57) ABSTRACT

An apparatus is provided for locking a first door of a motor vehicle in place relative to a second door as the first and second doors abut against each other when closed. The apparatus includes a base plate mounted to the first door. A latch release lever is pivotally mounted to the base plate for movement between a neutral position and a release position. In the release position, the latch release lever actuates at least one door latch to release the first door. A plunger is slidably mounted to the first door and movable between an open position and a closed position engaging the latch release lever. Closing the second door while the first door is closed moves the plunger from the open position to the closed position to prevent the latch release lever from pivoting into the release position.

10 Claims, 7 Drawing Sheets

LOCKING ASSEMBLY FOR REAR DOOR

CROSS-REFERENCE TO RELATED APPLICATION

This application claims priority to and all the benefits of U.S. Provisional Application Ser. No. 60/652,558, filed on Feb. 14, 2005 and entitled "Locking Assembly for Rear Door."

FIELD OF THE INVENTION

This invention relates to a locking assembly for a vehicle door. More specifically, the invention relates to an assembly that disables the door latches on a rear-facing door on a vehicle with a pair of side doors that open in opposed directions.

DESCRIPTION OF RELATED ART

Many pick-up trucks include a passenger cab having a rear seat positioned behind a front row of seats to accommodate additional passengers. These pick-up trucks typically include a third or fourth rear door located directly behind a front door to aid passengers when entering and exiting the rear seats. The rear door also provides convenient access to the space behind the front row of seats during loading and unloading of items. In certain pick-up trucks, the front and rear doors swing open in opposite directions from one another, an arrangement that is historically referred to as a "clamshell design".

For safety reasons, the rear-facing door must not open when the front-facing door is closed, particularly if the vehicle is in motion. Thus, the rear door latches need to be disabled when the front door is closed. Preferably, the rear door handle should still be permitted to pivot freely while the door remains shut. Additionally, the rear-door locking assembly must be designed to tolerate "over-slamming" and ensure a secure latch when the front door is closed with exceptional force.

It is desired to provide an assembly that prevents the rear door from opening when the front door is closed or slammed shut. In addition, the rear-door locking assembly must be able to accommodate build variations caused by mounting each of the front and rear doors to the vehicle body. As each door's alignment may vary in position relative to the other, the locking assembly must be able to tolerate these variances.

SUMMARY OF THE INVENTION

According to one aspect of the invention, an apparatus is provided for locking a first door of a motor vehicle in place relative to a second door as the first and second doors abut against each other when closed. The apparatus includes a base plate mounted to the first door. A latch release lever is pivotally mounted to the base plate for movement between a neutral position and a release position. In the release position, the latch release lever actuates at least one door latch to release the first door. A plunger is slidably mounted to the first door and movable between an open position and a closed position engaging the latch release lever. Closing the second door while the first door is closed moves the plunger from the open position to the closed position to prevent the latch release lever from pivoting into the release position.

BRIEF DESCRIPTION OF THE DRAWINGS

Advantages of the present invention will be readily appreciated as the same becomes better understood be reference to the following detailed description when considered in connection with the accompanying drawings wherein.

DETAILED DESCRIPTION OF THE PREFERRED EMBODIMENT

Figure 1:
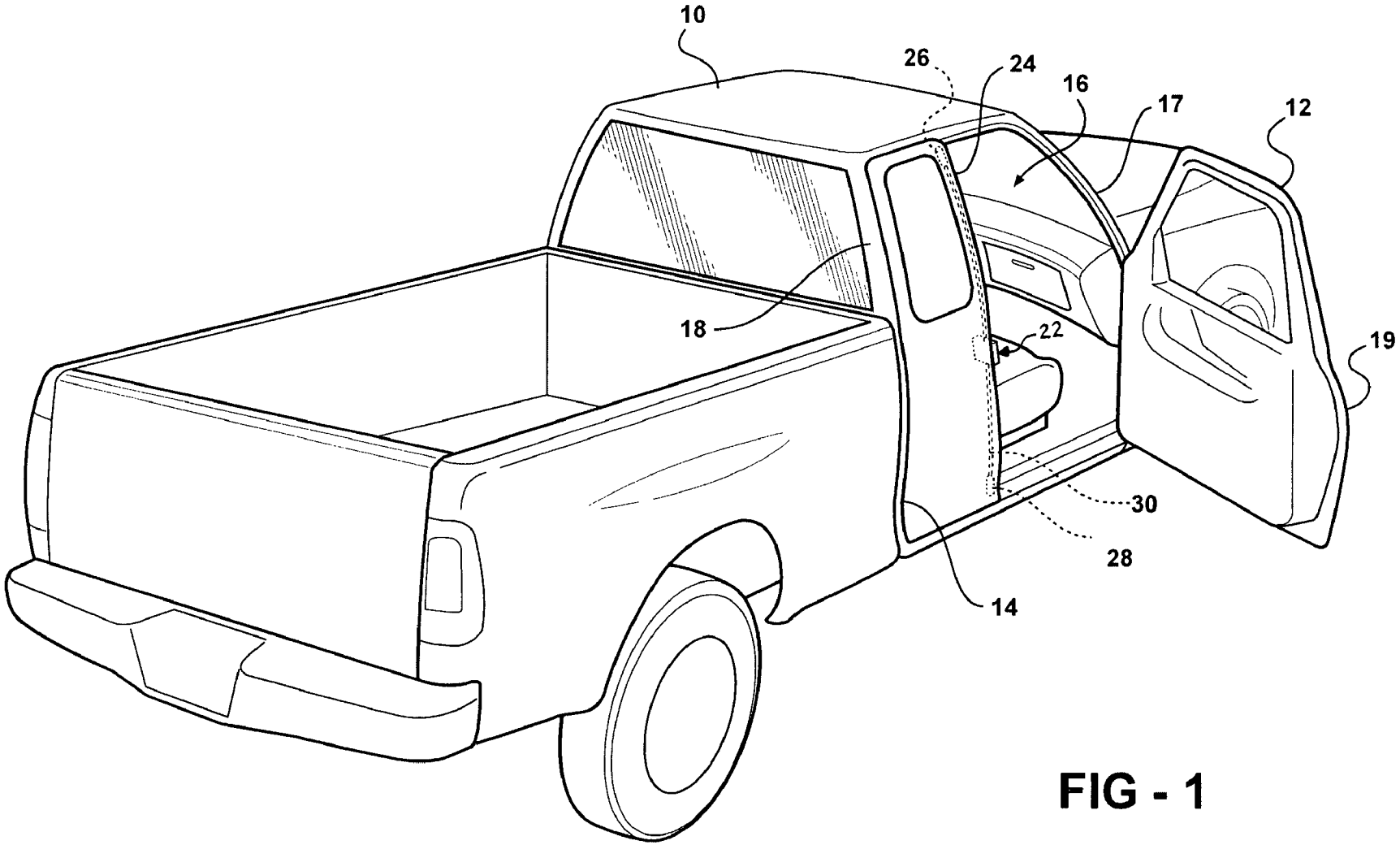
FIG. 1 is a rear perspective view of a motor vehicle.

Referring to FIG. 1, a motor vehicle 10 includes two front doors 12 (one shown) and a rear or third door 14 directly rearward thereto for providing access to a passenger compartment 16. In the embodiment shown, the motor vehicle 10 is a pick-up truck. The front door 12 is mounted along an A-pillar 17 and the rear door 14 is mounted along a C-pillar 18, thereby obviating the need for a B-pillar between the A-pillar 17 and the C-pillar 18. The front 12 and rear 14 doors open in opposite directions to allow individuals to comfortably enter and exit a rear portion of the passenger compartment 16. A portion of the facing edges on both of the front 12 and rear 14 doors overlap with each other when the doors 12, 14 are closed, providing complementary contact areas 19. In addition, easy loading and unloading of items into and out of the rear portion of the passenger compartment 16 is provided when the front 12 and rear 14 doors are open.

Figure 3:
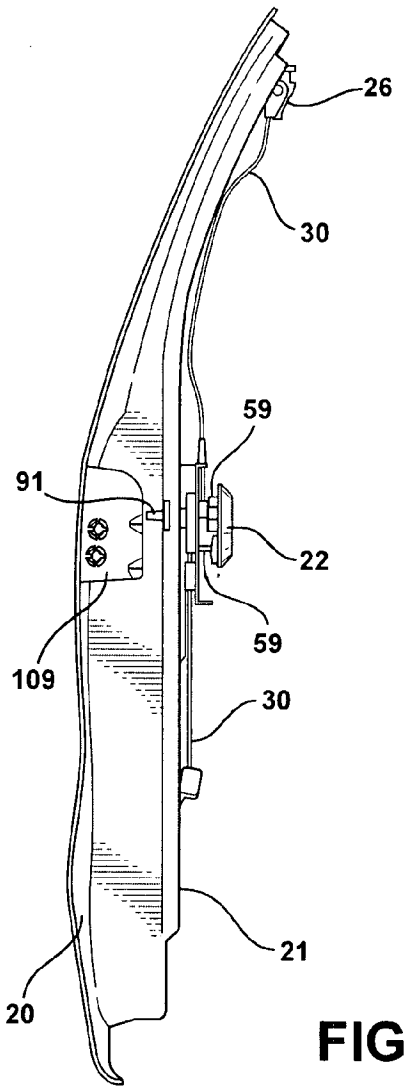
FIG. 3 is a front profile of the rear door shown in FIG. 2.
Figure 2:
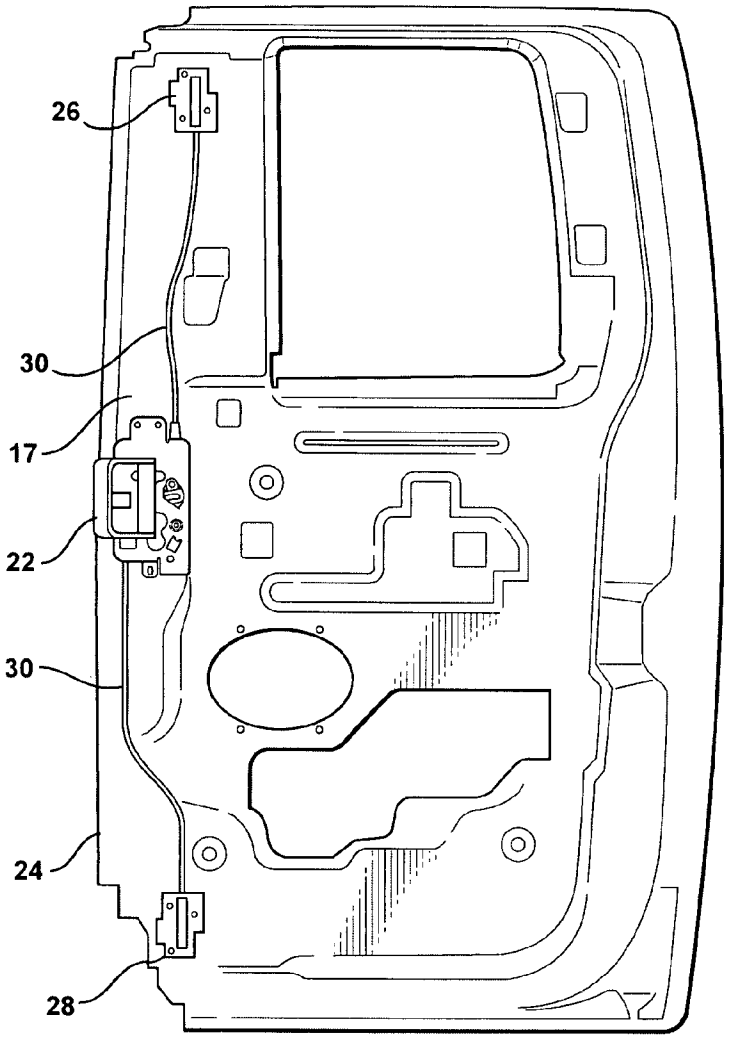
FIG. 2 is a side profile view of a rear door for the motor vehicle having a locking assembly in accordance with the invention.

Referring now to FIGS. 2 and 3, the rear door 14 is shown in greater detail. The rear door 14 includes an outer sheet metal 20 which is exposed to the outside of the vehicle 10 and an inner sheet metal 21, which is exposed to the inside of the vehicle 10. Trim components are typically mounted to the inner sheet metal 21, but have been omitted from FIGS. 2 and 3 for the purpose of clarity. A handle assembly, generally indicated at 22, is fixedly secured to the rear door 14 and is disposed adjacent a forward vertical edge 24 thereof. The handle assembly 22 is operatively connected to upper 26 and lower 28 door latches by links 30. The upper 26 and lower 28 door latches are operable to retain a bolt or striker (not shown) extending from the frame of the vehicle 10. Upon actuation of the handle assembly 22 while the front door 12 is open, the upper 26 and lower 28 door latches are unlatched to open the rear door 14.

Referring now to FIGS. 4 through 7, a rear door locking assembly is generally shown at 32. The locking assembly 32 includes a base plate 34 having an outward side 36 (best see in FIG. 7) facing towards the outside of the vehicle 10 and an inward side 38 (best seen in FIG. 6) facing towards the interior of the vehicle cabin. The base plate 34 further includes a pair of mounting flanges 40 to secure the base plate 34 to the inner sheet metal 21, as shown in FIGS. 2 and 3, specifically over the rear surface of contact area 19. Each mounting flange 40 has at least one fastener hole 41 to secure the base plate 34 to the inner sheet metal 21 via bolts, screws or the like. The base plate 34 further includes a pair of handle release apertures 42, a lock release aperture 43 and a locking pin aperture 44 passing from outward side 36 to inward side 38. The handle release apertures 42, lock release aperture 43, and locking pin apertures 44 are described in greater detail below.

Figure 6:
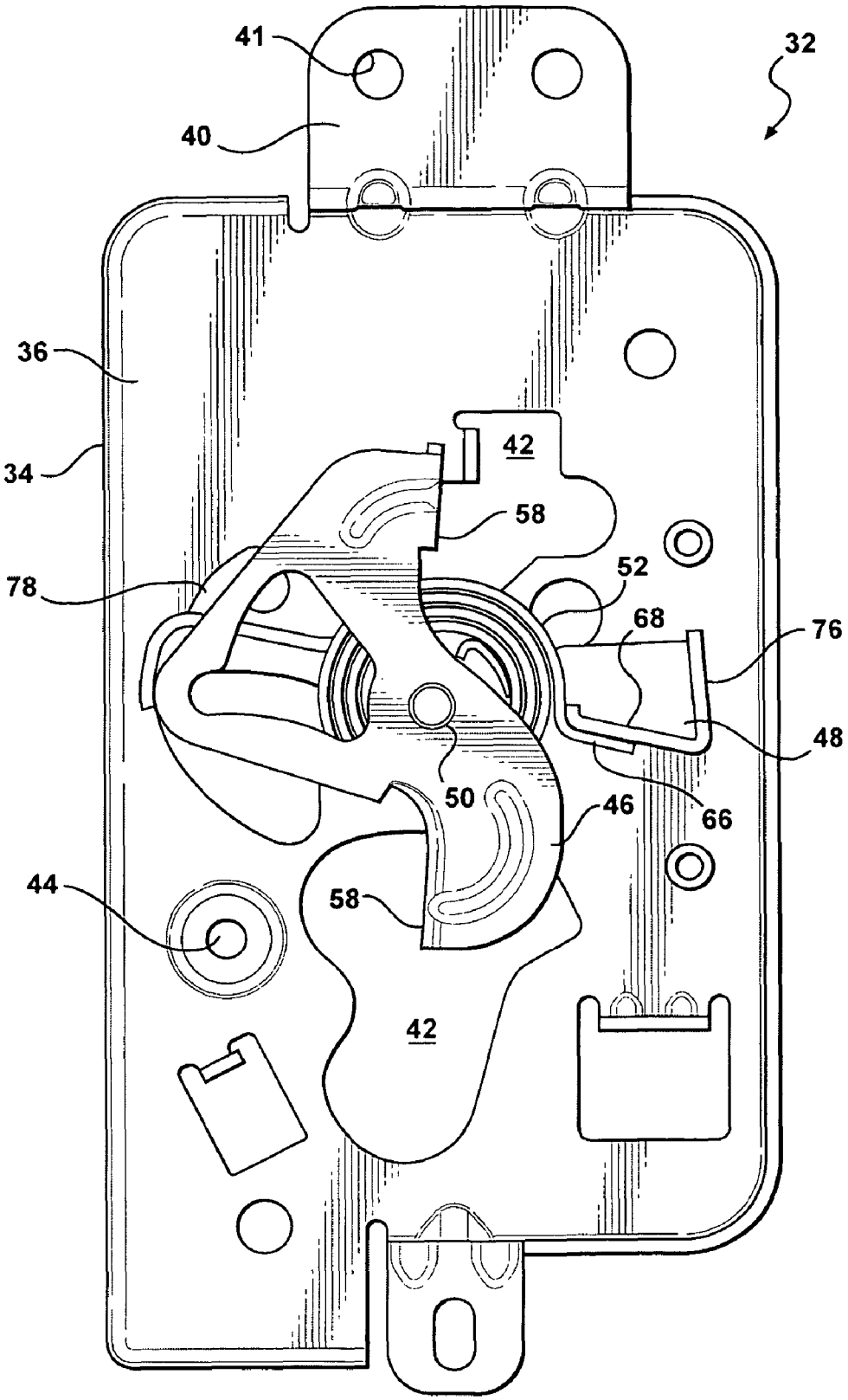
FIG. 6 is a top view of the locking assembly.
Figure 7:
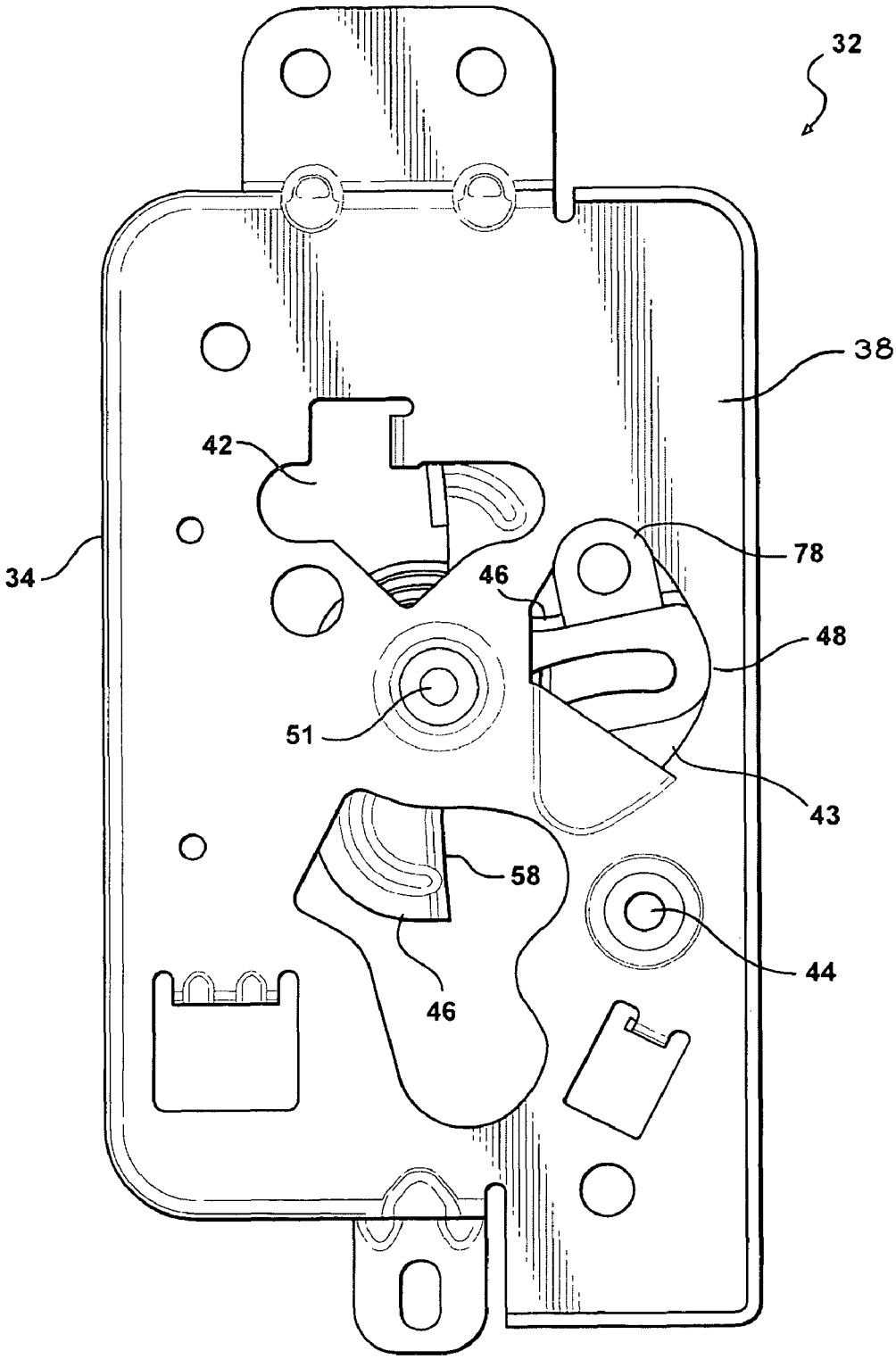
FIG. 7 is a bottom view of the locking assembly.
Figure 8:
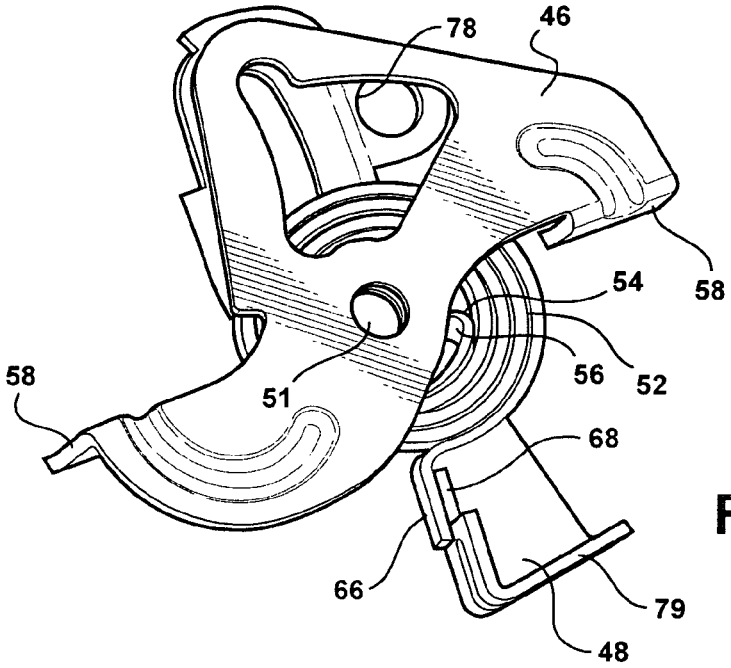
FIG. 8 is a perspective view of a handle release lever and latch release lever of the locking assembly.

A handle release lever 46 and a latch release lever 48 are each pivotally mounted to the outward side 36 of the base plate 34 around a common first axis 50. A pin aperture 51 on the handle release lever 46 locates the handle release lever 46 on a pivot pin (not shown) mounted to the base plate 34 to form the first axis 50. A clock spring 52, mounted around first axis 50 between handle release lever 46 and the base plate 34 biases handle release lever 46 into a neutral position (as shown in FIG. 6.) As can be best seen in FIG. 8, an inner arm 54 on the clock spring 52 abuts against a depending tab 56 on the handle release lever 46. The handle release lever 46 includes a pair of oppositely facing tabs 58. A pair of inner handle arms 59, shown in FIG. 3, extending from the handle assembly 22 passes through the handle release apertures 42 in the base plate 34 and abuts against each of the tabs 58. Thus, by actuating the handle assembly 22 out of a rest position in either direction (i.e., inwards or outwards of the vehicle 10), one of the pair of inner handle arms 59 engages one of the oppositely facing tabs 58 to pivot the handle release lever 46 out of the neutral position into one of two release positions. The range of motion of the handle release lever 46 is limited by edges 60 in the base plate 34 to prevent over travel of the handle release lever 46.

Figure 4:
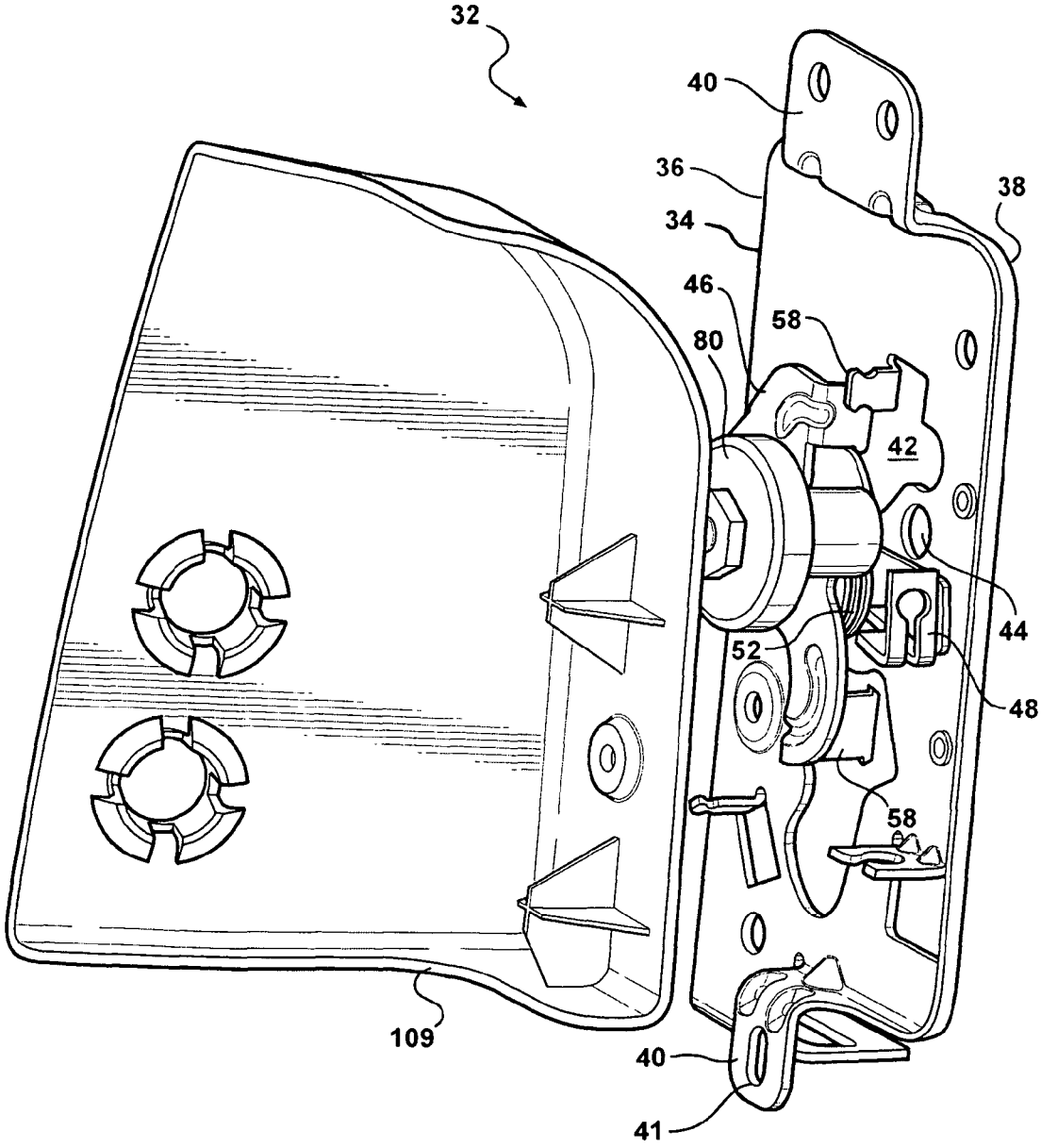
FIG. 4 is a perspective view of the locking assembly shown in FIG. 2.
Figure 5:
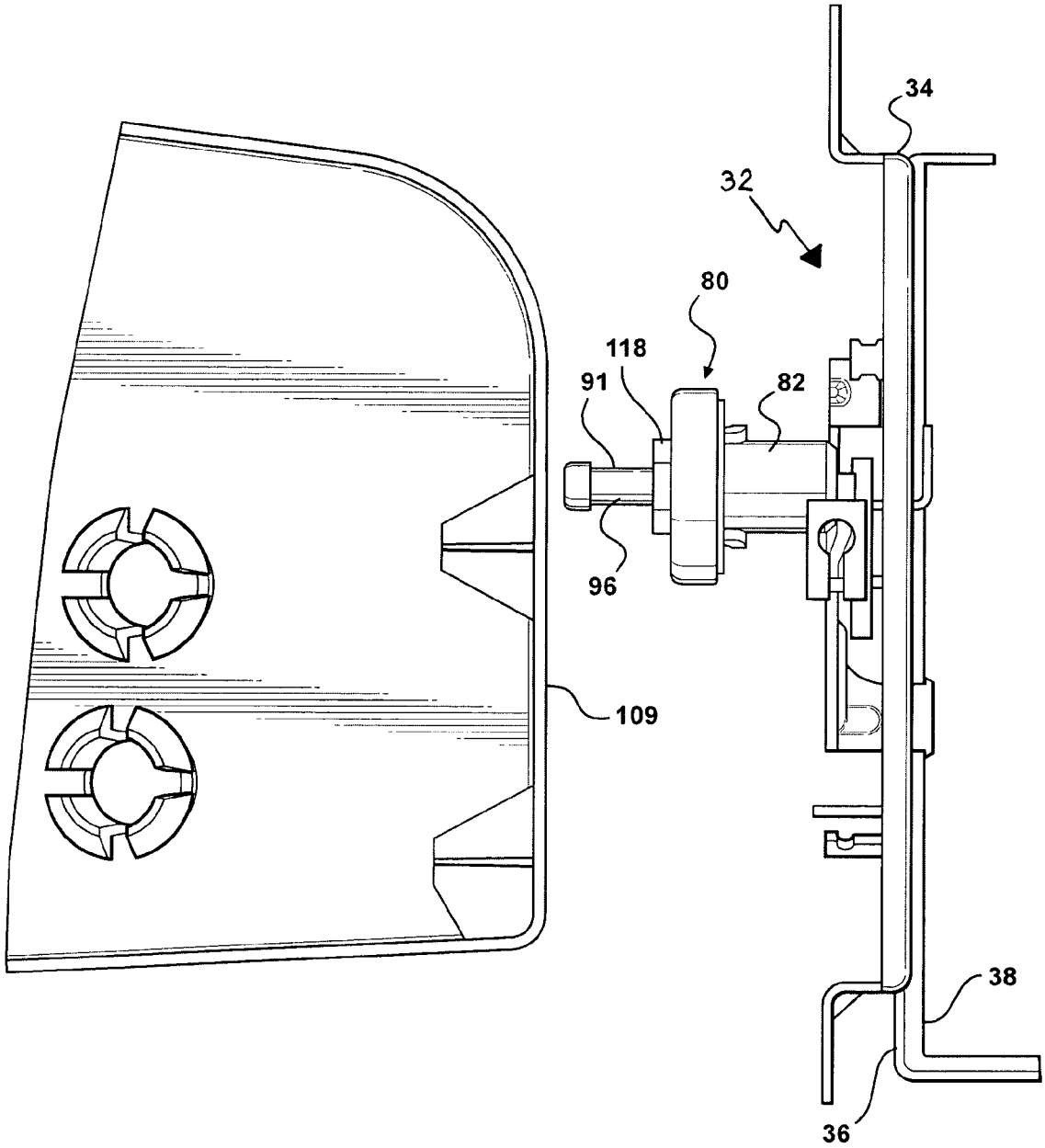
FIG. 5 is a side profile view of the locking assembly shown in FIG. 2.

The latch release lever 48 is also pivotally mounted around the first axis 51 formed by the pivot pin on the side of clock spring 52 opposite the handle release lever 46. A pin aperture 64 locates latch release lever 48 on first axis 51. The clock spring 52 biases the latch release lever 48 into a neutral position, as shown in FIG. 4. An outer arm 66 on the clock spring 52 abuts against a depending tab 68 on the latch release lever 48. The latch release lever 48 extends between opposing release ends 76, 78. Each of the release ends 76, 78 is attached to one of the links 30. Thus, the pivoting of the latch release lever 48 into a release position pulls each of the links 30 to unlatch the upper 26 and lower 28 door latches. A portion of the latch release lever 48 extends through the release aperture 43 so that one of the release ends 78 is located on the outward side 36 of base plate 34.

In operation, actuating the handle assembly 22 pivots the handle release lever 46 into either of the release positions. In turn, the clock spring 52 tightens, thereby actuating the latch release lever 48 to pivot into the release position. Once the handle assembly 22 is released, both the latch release lever 48 and the handle release lever 46 are returned to their respective neutral positions by the clock spring 52.

Figure 9:
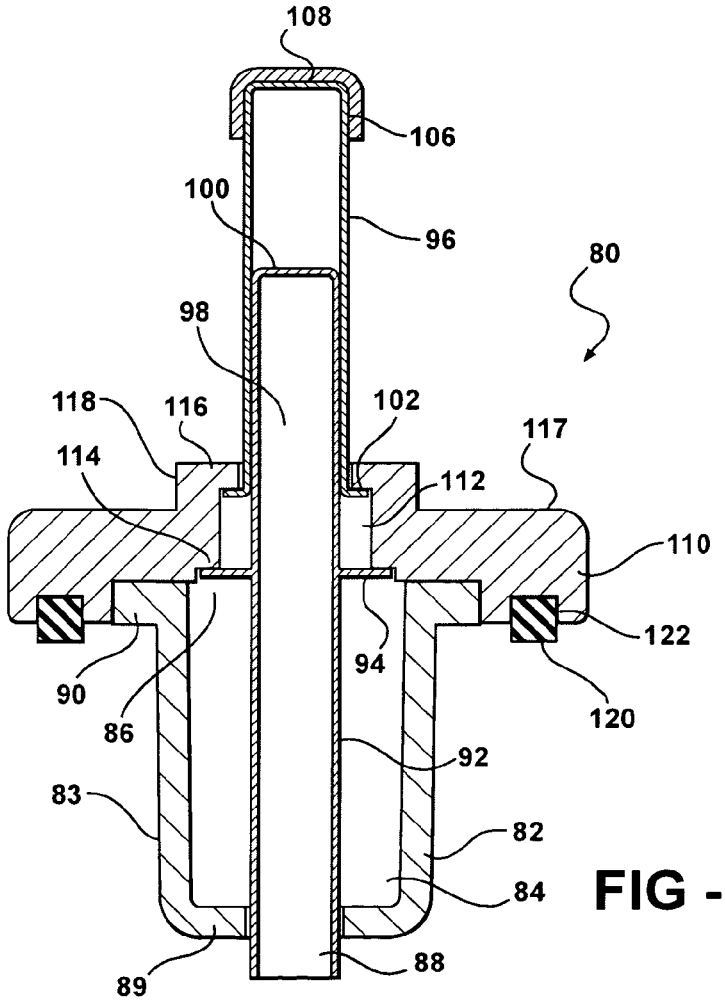
FIG. 9 is a side cross-sectional view of a plunger assembly for selectively engaging the latch release lever.

A plunger assembly 80 is mounted to both the inward and outward sides of the contact area 19 on the rear door 14. The plunger assembly 80 includes a canister 82 that is mounted to the rear door 14 through apertures (not shown) in both the outer 20 and inner 21 sheet metals 20 proximate the outward side 36 of the base plate 34. Referring to FIG. 9, the canister 82 includes a cylindrical sidewall 83 defining a compartment 84. At one end of the cylindrical sidewall 83 is a first aperture 86 and at the other end is a second aperture 88. The second aperture 88 is narrower than the first aperture 86 due to an inner flange 89 that extends inwards from the edge of cylindrical sidewall 83. An outer flange 90 extends outwards from the edge of the cylindrical sidewall 83 near the first aperture 86. The outer flange 90 abuts against the outer sheet metal 20, as shown in FIG. 2.

A dual-pin plunger 91 is slidably mounted in the canister 82 for movement between an open position and a closed position. A portion of the plunger 91 extends out though both the first aperture 86 and the second aperture 88. The plunger 91 includes an inner pin 92 running coaxially through the canister 82 and sized to provide a slidable fit through the second aperture 88. Partway along its length, the inner pin 92 includes a radial flange 94 extending outwards and sized to prevent the inner pin 92 from exiting the canister 82 through the second aperture 88. A helical spring 93 (not shown) is coiled around the inner pin 92 between the radial flange 94 and the inner flange 89 on the canister 82 for biasing the inner pin 92 towards the first aperture 86 and away from the second aperture 88.

The plunger 91 also includes a cylindrical outer pin 96, having an open end 98, concentrically and slidably mounted over a distal end 100 of the inner pin 92. An outer radial flange 102 extends outwards from the open end 98 of the outer pin 96, limiting the distance the outer pin 96 can slide over the inner pin 92. A helical spring 104 (not shown) coiled around the inner pin 92 between the radial flange 94 and the outer radial flange 102 biases outer pin 96 away from the radial flange 94. A pin cap 106, manufactured out of a resilient material is mounted over a closed end 108 of outer pin 96. The pin cap 106 provides the contact point for the front door 12 when both doors 12, 14 are closed. When the front door 12 is closed, a resilient bezel 109, mounting to contact area 19 on the inner sheet metal 21 of the front door 12 contacts the pin cap 106 to depress the outer pin 96.

A plunger cap 110 abuts the outer sheet metal 20 and is mounted over the outer flange 90 on the canister 82 to provide a weather-tight seal over the first aperture 86. A pin aperture 112 located in the center of the plunger cap 110 communicates with the compartment 84 to provide a passageway for the inner pin 92 and the outer pin 96. The pin aperture 112 is narrowed by a first shoulder 114 and narrowed again by a second shoulder 116. The first shoulder 114 is sized as to prevent the radial flange 94 on the inner pin 92 from entering the pin aperture 112, thereby retaining the inner pin 92 within the compartment 84. The second shoulder 116 is sized as to prevent the outer pin 96 from exiting the pin aperture 112. A hex head 118 is provided around the pin aperture 112 on an outer surface 117 of the plunger cap 110 to assist in the mounting of the canister 82 to the rear door 14. An O-ring 120 is formed from a resilient material and fitted into a groove 122 on the inner surface of the plunger cap 110 against the outer sheet metal 20 to prevent moisture from entering through the vehicle door.

In operation, closing the front door 12 while the rear door 14 is closed moves the plunger 91 from its open position to its closed position. More specifically, closing the rear door 12 brings the bezel 109 into contact with the pin cap 106. The outer pin 96 is depressed inwards (i.e., towards the base plate 34), which in turn moves the inner pin 92 so that the plunger 91 is in the closed position. The inner pin 92 moves through a locking aperture 124 on the base plate 34. As a result, the handle release lever 46 can pivot freely, but the latch release lever 48 is blocked by the inner pin 92 from pivoting into its release position. Thus, the upper 26 and lower 28 door latches remain latched.

When the front door 12 is opened, the plunger 91 returns to its open position. The helical spring 104 returns the outer pin 96 outwards away from the radial flange 102. The helical spring 93 pushes the inner pin 92 towards the first aperture 86 so that the inner pin 92 is fully clear of the motion path of the latch release lever 48. The latch release lever 48 can now pivot freely in tandem with the handle release lever 46 to release the upper 26 and lower 28 door latches.

The dual pin construction of the plunger 91 accommodates over-slamming of the front door 12 as helical springs 93, 104 absorb the excess force and prevent the misalignment of the plunger 91. In addition, the use of a double-pin construction for the plunger 91 provides for a greater build tolerance between the positions of the front door 12 and the rear door 14 when the doors 12, 14 are closed. The plunger 91 provides a reliable and inexpensive way to secure the rear door 14 when the front door 12 is open, without the need for additional locking mechanisms.

The invention has been described in an illustrative manner. It is to be understood that the terminology, which has been used, is intended to be in the nature of words of description rather than of limitation. Many modifications and variations of the invention are possible in light of the above teachings. Therefore, within the scope of the appended claims, the invention may be practiced other than as specifically described.

What is claimed:

1. An apparatus for locking a first door of a motor vehicle in place relative to a second door as the first and second door abut against each other when closed, the apparatus comprising:

a base plate mounted to the first door;

a latch release lever pivotally mounted to the base plate for movement between a neutral position and a release position, the latch release lever operable to actuate at least one latch to release the first door when pivoted into the release position; and a plunger assembly including a canister coupled to the first door, said canister including a cylindrical sidewall defining a first aperture at one end and a second aperture at another end, said plunger assembly also including a cap mounted to said canister and having a pin aperture open to said first aperture, said pin aperture narrowed by a first shoulder and a second shoulder of said cap, said plunger assembly including a plunger having outer and inner pins slidably mounted to said canister and each received within said pin aperture of said cap, said outer pin extending through said first aperture and having an outer radial flange selectively abutting said second shoulder to prevent said outer pin from exiting said pin aperture of said cap, said inner pin extending through said second aperture of said canister and having a radial flange selectively abutting said first shoulder for retaining said inner pin within said canister;

wherein closing the second door while the first door is closed causes the second door to contact the plunger and depress said outer pin thereby moving said inner pin so that said inner pin blocks said latch release lever and prevents movement thereof from said neutral position to said release position.

2. The apparatus of claim 1 wherein the inner and outer pins are coaxial.

3. The apparatus of claim 1 wherein the cap on the canister includes a hex surface.

4. An apparatus for locking a first door of a motor vehicle in place relative to a second door as the first and second door abut against each other when closed, the apparatus comprising:

a base plate mounted to the first door;

a latch release lever pivotally mounted to the base plate for movement between a neutral position and a release position, the latch release lever operable to actuate at least one latch to release the first door when pivoted into the release position; and a plunger assembly including a canister coupled to the first door, said canister including a cylindrical sidewall defining a first aperture at one end and a second aperture at another end, said plunger assembly also including a cap mounted to said canister and having a pin Aperture open to said first aperture, said plunger assembly including a plunger having outer and inner pins slidably mounted to said canister and each received within said pin aperture of said cap, said outer pin extending through said first aperture and having an outer radial flange selectively abutting a portion of said cap to prevent said outer pin from exiting said pin aperture of said cap, said inner pin extending through said second aperture of said canister and having a radial flange selectively abutting a portion of said cap for retaining said inner pin within said canister wherein closing the second door while the first door is closed depresses the outer pin thereby moving said inner pin so that said inner pin blocks said latch release lever and prevents movement thereof from said neutral position to said release position.

5. The apparatus of claim 4 wherein the apparatus further includes a handle release lever pivotally mounted to the base plate for movement between a neutral position and a release position wherein actuating the handle release lever urges the latch release lever towards the release position.

6. The apparatus of claim 5 wherein the handle release lever is coaxial with the latch release lever.

7. The apparatus of claim 6 wherein the apparatus further includes a clock spring having a first arm abutting against the latch release lever and urging the latch release lever towards the neutral position.

8. The apparatus of claim 7 wherein the clock spring includes a second arm abutting against the handle release lever, the second arm urging the handle release lever towards the neutral position.

9. The apparatus of claim 8 wherein pivoting the handle release lever towards the release position causes the clock spring to urge the latch release lever into its release position.

10. The apparatus of claim 4 wherein the inner and outer pins are coaxial.

* * * * *